US009410770B2

(12) United States Patent
Zimmer

(10) Patent No.: US 9,410,770 B2
(45) Date of Patent: Aug. 9, 2016

(54) MOUNT ASSEMBLY FOR INTERCHANGING OPTICAL SIGHTS

(71) Applicant: Trent Zimmer, Houma, LA (US)

(72) Inventor: Trent Zimmer, Houma, LA (US)

( * ) Notice: Subject to any disclaimer, the term of this patent is extended or adjusted under 35 U.S.C. 154(b) by 0 days.

(21) Appl. No.: 14/726,481

(22) Filed: May 30, 2015

(65) Prior Publication Data

US 2015/0276350 A1 Oct. 1, 2015

Related U.S. Application Data

(63) Continuation of application No. 14/183,098, filed on Feb. 18, 2014, now Pat. No. 9,062,936.

(60) Provisional application No. 61/766,579, filed on Feb. 19, 2013.

(51) Int. Cl.
*F41G 11/00* (2006.01)

(52) U.S. Cl.
CPC ..... *F41G 11/001* (2013.01); *F41G 11/003* (2013.01); *Y10T 29/49826* (2015.01)

(58) Field of Classification Search
CPC ..... F41G 1/10; F41G 1/16; F41G 1/26; F41G 1/30; F41G 11/002; F41G 11/003; F41G 11/001; Y10T 29/29
USPC ..... 42/111, 13, 7, 76.1, 124, 118
See application file for complete search history.

(56) References Cited

U.S. PATENT DOCUMENTS 6,327,806 B1 * 12/2001 Paige ..... F41G 1/30 42/113
7,946,074 B2 * 5/2011 Nemec ..... F41G 1/01 42/113
8,832,983 B1 * 9/2014 Wolf ..... F41A 3/12 42/16
8,893,422 B2 * 11/2014 Wolf ..... F41A 3/12 42/111
2005/0057808 A1 * 3/2005 Houde-Walter ..... F41C 27/00 359/566
2007/0234625 A1 * 10/2007 Kidd ..... F41G 1/02 42/111
2008/0062487 A1 * 3/2008 Houde-Walter ..... F41C 27/00 359/13

(Continued)

OTHER PUBLICATIONS

Mr. Grouchy (John), mini-RDS going mainstream with the FNP 45 Tactical [online], [dated Oct. 28, 2010], [retrieved on Jun. 10, 2016], Retrieved from the Internet: <URL: http://www.mrgrouchy.com/2010/10/28/mini-rds-going-mainstream-with-the-fnp-45-tactical/>.

(Continued)

*Primary Examiner* — Samir Abdosh
*Assistant Examiner* — John D Cooper
(74) *Attorney, Agent, or Firm* — Asgaard Patent Services, LLC; F. Wayne Thompson, Jr.

(57) ABSTRACT

Implementations of a mount assembly for interchanging optical sights on a pistol are provided. In some implementations, the mount assembly comprises an adaptor plate and a pistol slide having an adaptor interface. In some implementations, the adaptor interface of the pistol slide is configured to receive an adaptor plate therein. In some implementations, an optical sight may be secured to the adaptor plate. In some implementations, the walls of the adaptor interface may be constructed in the form of a female portion of a dovetail joint. In some implementations, the ends of the adaptor plate are constructed in the form of a male portion of a dovetail joint. In this way, when the adaptor plate is inserted into the adaptor interface a secure connection may be achieved. In some implementations, a dovetail configured to receive a rear sight is positioned between the ejection port and the adaptor interface of the pistol slide.

20 Claims, 4 Drawing Sheets

(56) References Cited

U.S. PATENT DOCUMENTS

| | | | | |
|---|---|---|---|---|
| 2013/0219767 | A1* | 8/2013 | Peterson | F41G 11/003 42/113 |
| 2013/0283660 | A1* | 10/2013 | Matthews | F41G 1/30 42/113 |
| 2014/0109456 | A1* | 4/2014 | Jung | F41G 1/30 42/113 |
| 2014/0150325 | A1* | 6/2014 | Keng | F41G 11/003 42/118 |

OTHER PUBLICATIONS

Jeff Compoc, FNH USA's FNP-45 Tactical [online], [dated Aug. 8, 2010], [retrieved on Jun. 10, 2016], Retrieved from the Internet: <URL: http://gunblog.com/fnh-tactical-45>.

FNP-45 Tactical [online], [dated Jan. 18, 2010], [retrieved on Jun. 10, 2016], Retrieved from the Internet: <URL: http://soldiersystems.net/tag/fnh-usa/page/3/>.

David Crane, FN FNX-45 Tactical .45 ACP Polymer-Framed Combat/Tactical Pistol with Trijicon RMR (Ruggedized Miniature Reflex) RM02 Mini-Red Dot Optical Sight and Extended Threaded Barrel for Silencer/Sound Suppresor! [Online], [dated Jul. 22, 2013], [retrieved on Jun. 10, 2016], Retrieved from the Internet: <URL: http://www.defensereview.com/fn-fnx-45-tactical-45-acp-polymer-framed-combattactical-pistol-with-trijicon-rmr-ruggedized-miniature-reflex-rm02-mini-red-dot-optical-sight/>.

Black FNP 45 Tactical [online], [dated Sep. 24, 2010], Retrieved from the internet: <URL: http://www.handgunsmag.com/uncategorized/hg_lipsey_080210wo/>.

Armymedicdad, New FNH Handguns for 2010 [online], [dated Nov. 22, 2009], [retrieved on Jun. 10, 2016], Retrieved from he Internet: <URL: https://www.ar15.com/archive/topic.html?b=5&f=53&t=86055>.

* cited by examiner

MOUNT ASSEMBLY FOR INTERCHANGING OPTICAL SIGHTS

CROSS REFERENCE TO RELATED APPLICATION

This is a continuation application claiming the benefit of U.S. patent application Ser. No. 14/183,098 which was filed on Feb. 18, 2014, which claims the benefit of U.S. Provisional Patent Application Ser. No. 61/766,579, which was filed on Feb. 19, 2013, the entireties of both applications are hereby incorporated by reference for all purposes.

TECHNICAL FIELD

This disclosure relates to implementations of a mount assembly for interchanging optical sights on a pistol.

BACKGROUND

Most pistols come from the factory with iron sights. Typical iron sights provided on a pistol include a front post and a rear notch which must be aligned to aim the pistol. Mounting an optical sight on a pistol offers a shooter several advantages over using iron sights alone. Optical sights provide a simple sight picture comprised of a single illuminated aiming point in place of the front post and rear notch of iron sights. In this way, a shooter's accuracy and/or speed with a pistol may improve. Further still, a shooter may be able to aim with the illuminated aiming point of an optical sight in environmental conditions that would make visual alignment of the iron sights difficult or impossible, low light conditions for example.

However, given the design of most pistols, attaching an optical sight may be difficult to do. In order to accommodate an optical sight, the slide of the pistol may need to be permanently modified in order to receive an optical sight thereon, milled for example. If the user decides to switch to a new optical sight, further modifications to the pistol may be required. In some instances, the pistol may not be suitable for further modification.

DETAILED DESCRIPTION

Implementations of a mount assembly for interchanging optical sights on a pistol are provided. In some implementations, the mount assembly comprises an adaptor plate and a pistol slide having an adaptor interface. In some implementations, the adaptor interface of the pistol slide is configured to receive an adaptor plate therein. In some implementations, an optical sight may be secured to the adaptor plate.

In some implementations, a pistol slide may be manufactured with an adaptor interface in accordance with the present disclosure. In some implementations, a pistol slide may be machined or otherwise modified to have an adaptor interface in accordance with the present disclosure thereon.

In some implementations, the adaptor interface on the pistol slide may be a dovetail. In some implementations, the adaptor interface may be any shape suitable for receiving an adaptor plate.

In some implementations, the pistol slide may include a locking tab relief. In some implementations, the locking tab relief may include a threaded opening.

In some implementations, the adaptor plate may be any shape suitable for mounting an optical sight thereon. In some implementations, the adaptor plate may be configured to fit within the ridges of a dovetail. In some implementations, a top side of the adaptor plate may include a recoil lug thereon. In some implementations, the adaptor plate may include a locking tab thereon. In some implementations, the locking tab may be configured to fit within the locking tab relief of the pistol slide. In some implementations, adaptor plates may be configured to work with a variety of optical sights without departing from the scope of the present invention.

Figure 1:
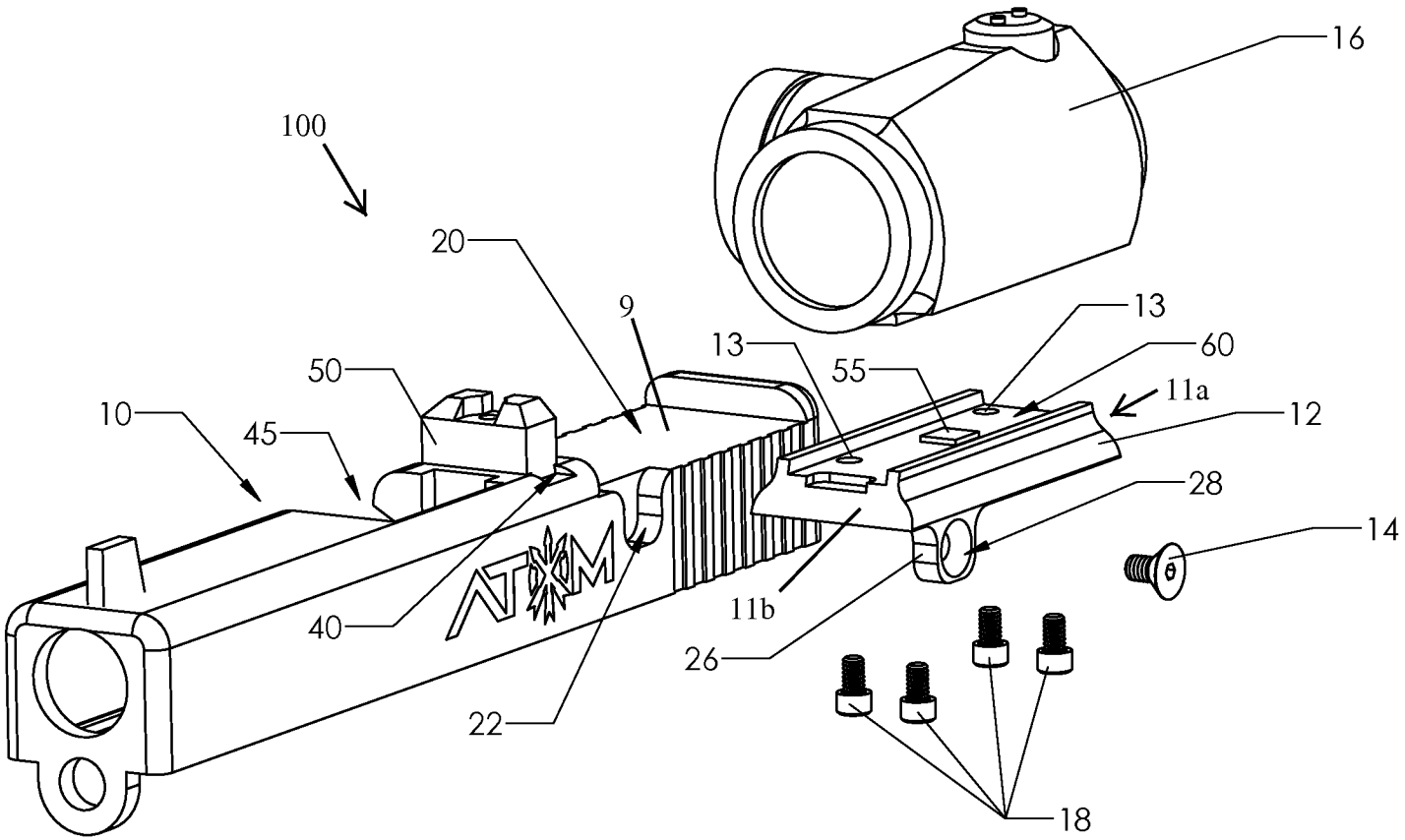
FIG. 1 illustrates an example mount assembly for interchanging optical sights according to the present disclosure.

FIG. 1 illustrates an example mount assembly 100 for interchanging optical sights on a pistol according to the present disclosure. Through the use of interchangeable adaptor plates constructed to receive optical sights thereon, a user may change the optical sight mounted on a pistol slide by changing adaptor plates. In this way, further modification to the pistol slide is not required to accommodate a variety of optical sights.

As shown in FIG. 1, in some implementations, the mount assembly 100 comprises an adaptor plate 12 and a pistol slide (e.g., pistol slide 10) having an adaptor interface 20. In some implementations, an optical sight (e.g., optical sight 16) may be secured to the adaptor plate 12.

In some implementations, a pistol slide may be manufactured with an adaptor interface 20 in accordance with the present disclosure. In some implementations, a pistol slide may be machined or otherwise modified to have an adaptor interface 20 in accordance with the present disclosure. In some implementations, the adaptor interface 20 has end walls 21*a, b* and a bottom surface 9. In some implementations, the bottom 9 of the adaptor interface 20 is recessed below the top surface of the pistol slide. In this way, an optical sight attached to an adaptor plate 12 may sit lower on the handgun slide than if the optical sight was mounted on top of the handgun slide. In some implementations, the depth of the bottom 9 of the adaptor interface 20 on a handgun slide may be limited by the amount of material which may be removed and/or omitted without compromising the structural integrity of the handgun slide.

Figure 2:
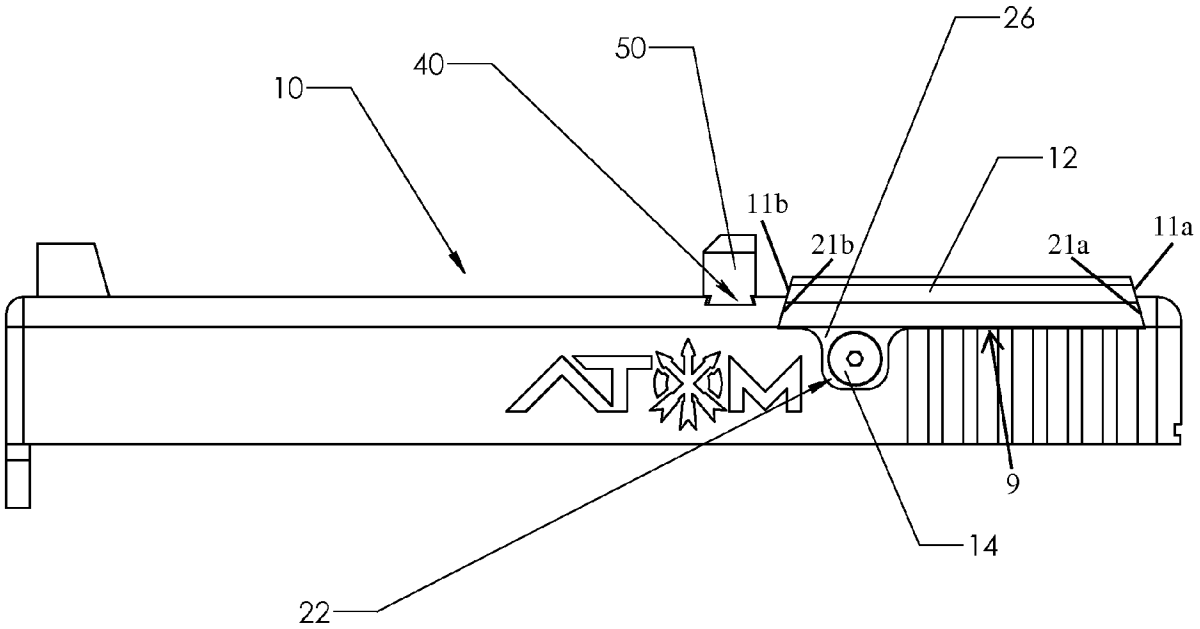
FIG. 2 illustrates is a side view of the example mount assembly of FIG. 1.

In some implementations, the adaptor interface 20 of the pistol slide 10 may be constructed to receive an adaptor plate 12 therein (see, e.g. FIG. 2). In some implementations, the walls 21*a*, 21*b* may be slanted at an angle relative to the bottom 9 of the adaptor interface 20. In some implementations, the ends 11*a*, 11*b* of the adaptor plate 12 may be slanted and configured to interface with the slanted walls 21*a*, 21*b* of the adaptor interface 20. In some implementations, the walls 21*a*, 21*b* of the adaptor interface 20 may be constructed in the form of a female portion of a dovetail joint (see, e.g., FIG. 2). In some implementations, the ends 11*a, b* of the adaptor plate 12 are constructed in the form of a male portion of a dovetail joint (see, e.g., FIG. 4). In this way, when the adaptor plate 12 is inserted into the adaptor interface 20 a secure connection may be achieved (see, e.g., FIG. 2). In some implementations, the adaptor interface 20 may be any shape suitable for receiving an adaptor plate 12 therein.

In some implementations, the pistol slide 10 may include a locking tab relief 22. In some implementations, the locking tab relief 22 may be located on a side of the handgun slide 10

Figure 3:
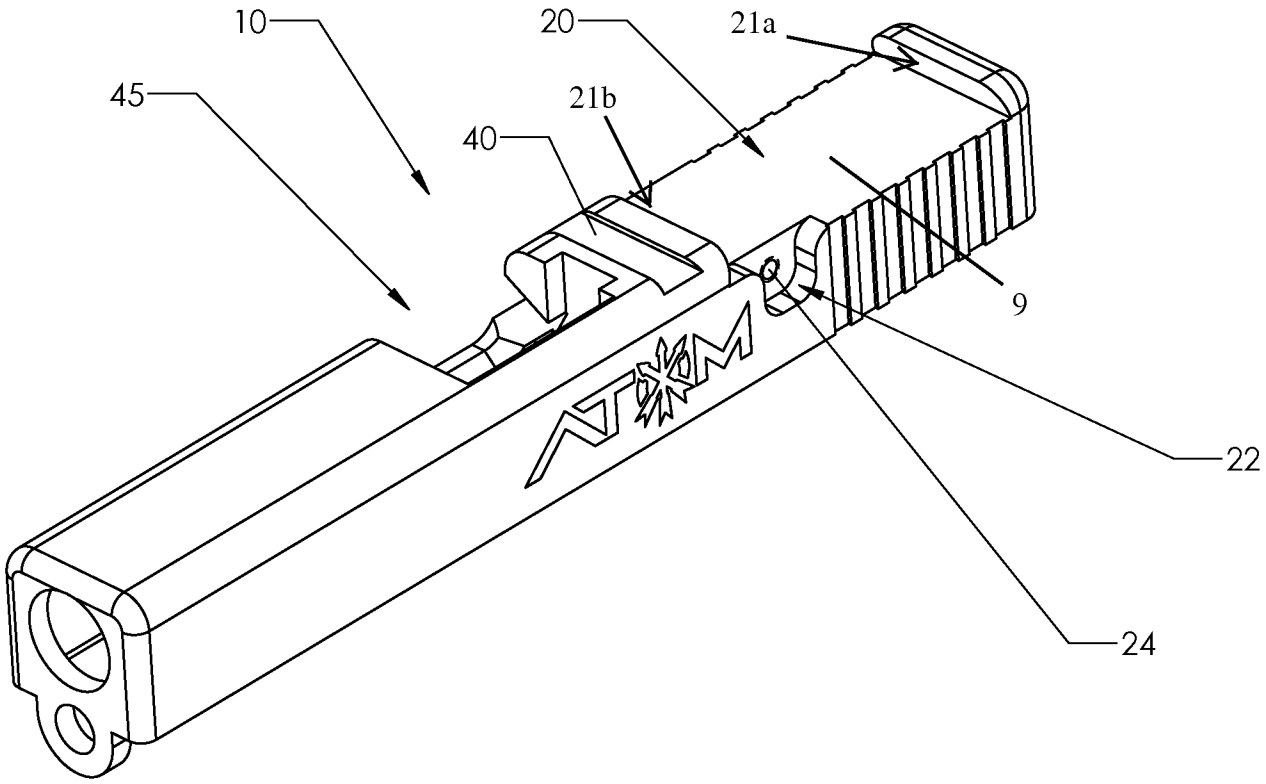
FIG. 3 illustrates a perspective side view of the example mount assembly of FIG. 1.

(see, e.g. FIG. 3). In some implementations, the locking tab relief 22 may include a threaded opening 24 therein (see, e.g., FIG. 3).

Figure 4:
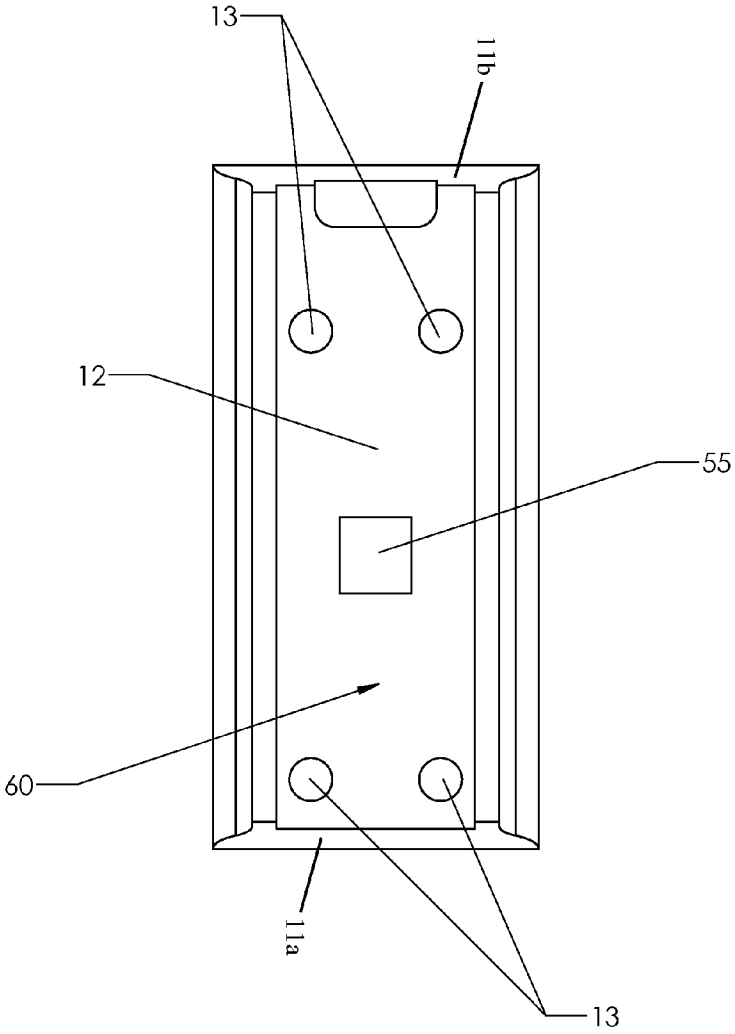
FIG. 4 illustrates an example adaptor plate according to the present disclosure.

In some implementations, the adaptor plate 12 may have the general shape of a rectangle (see, e.g., FIG. 4). In some implementations, a top side of the adaptor plate 12 may have a relief 60 therein configured to receive an optical sight (e.g., optical sight 16). In some implementations, the adaptor plate 12 may be any shape suitable for mounting an optical sight thereon. In some implementations, the optical sight may have an aiming point illuminated by electricity, tritium, a light emitting chemical reaction, or a combination thereof. In some implementations, the optical sight may be an Aimpoint® Micro optical sight, a DOCTER® red dot sight, a Leupold® Deltapoint, a Trijicon RMR®, or other optical sights having a similar foot print that are currently known or developed in the future.

In some implementations, the adaptor plate 12 may be configured to fit within the ridges of a dovetail joint (see, e.g. FIG. 2). In some implementations, the adaptor plate 12 may include one or more openings 13 therethrough (see, e.g. FIG. 4). In some implementations, the top side of the adaptor plate 12 may include a recoil lug 55 thereon. In this way, an attached optical sight may be prevented from sliding back and forth due to the incidental vibrations associated with the discharge of a pistol.

In some implementations, the adaptor plate 12 may include a locking tab 26 thereon. In some implementations, the locking tab 12 may extend from the bottom of the adaptor plate 12. In some implementations, the locking tab 26 may be configured to be received within the locking tab relief 22 of the pistol slide 10. In some implementations, the locking tab 26 may include an opening 28 therethrough.

To secure the optical sight 16 to the adaptor plate 12, the optical sight 16 may be oriented so that the openings 13 of the adaptor plate 12 are aligned with threaded openings located on a bottom side of the optical sight 16. Screws 18 are then inserted through the openings 13 of the adaptor plate 12 from a bottom side thereof and threadedly secured to the optical sight 16.

To remove the optical sight 16 from the adaptor plate 12, the above steps are performed in reverse.

To secure the adaptor plate 12 to a pistol slide 10 constructed in accordance with the present disclosure, the adaptor plate 12 may be inserted into the dovetail portion of the adaptor interface 20. The adaptor plate 12 will come to rest with the locking tab 26 seated within the locking tab relief 22 located on the pistol slide 10 (see, e.g., FIG. 2). A screw 14 is then inserted through the opening 28 of the locking tab 26 and threadedly secured into the threaded opening 24 of the locking tab 26 relief.

In some implementations, an additional dovetail 40 may be provided on the pistol slide 10 (see, e.g., FIG. 3). In some implementations, the dovetail 40 is located between the ejection port 45 and adaptor interface 20 of the pistol slide 10. In some implementations, the dovetail 40 may be constructed to receive a notch sight (notch sight 50) (see, e.g., FIG. 1). In some implementations, the dovetail 40 may be constructed to receive any rear sight suitable for use with a pistol. In this way, iron sights may be used in conjunction with some implementations of the mount assembly 100 disclosed herein.

In some implementations, the adaptor plate 12 of the mount assembly 100 may sit low enough within the adaptor interface 20 to allow a user to align the iron sights of a pistol while looking through an optical sight 16 mounted on an adaptor plate 12.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A mount assembly for securing an optical sight to a pistol, the mount assembly comprising:

a slide for use with a pistol, the slide comprising an adaptor interface, an ejection port, and a dovetail;

the adaptor interface comprising end walls and a bottom surface, wherein the bottom surface is recessed below the top of the slide;

the dovetail is located between the ejection port and the adaptor interface of the slide, wherein the dovetail is configured to receive a rear sight therein; and an adaptor plate configured to be received by the adaptor interface, the adaptor plate comprising a mounting surface configured to receive an optical sight thereon, wherein the mounting surface on a top side of the adaptor plate is recessed below the top of the slide when the adaptor plate has been received by the adaptor interface.

2. The mount assembly of claim 1, wherein the adaptor plate further comprises a tab extending from a bottom side thereof.

3. The mount assembly of claim 2, wherein the slide further comprises a tab relief that extends from an edge of the bottom surface of the adaptor interface along a side of the slide.

4. The mount assembly of claim 3, wherein the tab has an opening extending therethrough and the tab relief has a threaded opening therein, the opening of the tab is in axial alignment with the threaded opening of the tab relief.

5. The mount assembly of claim 1, wherein the end walls and the bottom surface of the adaptor interface form a dovetail joint.

6. The mount assembly of claim 5, wherein the ends of the adaptor plate form a male portion of a dovetail joint.

7. The mount assembly of claim 1, wherein the end walls are slanted relative to the bottom surface of the adaptor interface.

8. The mount assembly of claim 7, wherein the ends of the adaptor plate are slanted and configured to interface with the end walls of the adaptor interface.

9. The mount assembly of claim 1, wherein the mounting surface of the adaptor plate includes a recoil lug thereon.

10. A method of securing an optical sight to the slide of a pistol using the mount assembly of claim 1, the method comprising:

positioning an optical sight on the mounting surface of the adaptor plate;

attaching an optical sight to the mounting surface of the adaptor plate; and inserting the adaptor plate into the adaptor interface;

wherein the adaptor plate positions the optical sight on the slide of a pistol for use by a user.

11. The method of claim 10, wherein the adaptor plate further comprises a tab extending from a bottom side thereof and the slide further comprises a tab relief therein, the method further comprising:

positioning the adaptor plate so that the tab is on the same side of the slide as the tab relief; and inserting the adaptor plate into the adaptor interface so that the tab comes to rest within the tab relief.

12. The method of claim 10, the method further comprising:

inserting a rear sight into the dovetail of the slide.

13. A mount assembly for securing an optical sight to a pistol, the mount assembly comprising:

a slide for use with a pistol, the slide having an adaptor interface, the adaptor interface comprising end walls and a bottom surface, wherein the bottom surface is recessed below the top of the slide; and an adaptor plate configured to be received by the adaptor interface, the adaptor plate comprising a mounting surface configured to receive an optical sight thereon, wherein the mounting surface on a top side of the adaptor plate is recessed below the top of the slide when the adaptor plate has been received within the adaptor interface.

14. The mount assembly of claim 13, wherein the adaptor plate further comprises a tab extending from a bottom side thereof.

15. The mount assembly of claim 14, wherein the slide further comprises a tab relief that extends from an edge of the bottom surface of the adaptor interface along a side of the slide.

16. The mount assembly of claim 15, wherein the tab has an opening extending therethrough and the tab relief has a threaded opening therein, the opening of the tab is in axial alignment with the threaded opening of the tab relief.

17. The mount assembly of claim 13, wherein the mounting surface of the adaptor plate includes a recoil lug thereon.

18. A method of securing an optical sight to the slide of a pistol using the mount assembly of claim 13, the method comprising:

positioning an optical sight on the mounting surface of the adaptor plate;

attaching an optical sight to the mounting surface of the adaptor plate; and inserting the adaptor plate into the adaptor interface;

wherein the adaptor plate positions the optical sight on the slide of a pistol for use by a user.

19. The method of claim 18, wherein the adaptor plate further comprises a tab extending from a bottom side thereof and the slide further comprises a tab relief therein, the method further comprising:

positioning the adaptor plate so that the tab is on the same side of the slide as the tab relief; and inserting the adaptor plate into the adaptor interface so that the tab comes to rest within the tab relief.

20. The method of claim 18, wherein the slide further comprises an ejection port and a dovetail, the dovetail is located between the ejection port and the adaptor interface, the method further comprising:

inserting a rear sight into the dovetail of the slide.

* * * * *